United States Patent [19]

Murai

[11] Patent Number: 4,629,678

[45] Date of Patent: Dec. 16, 1986

[54] INTERNAL LATENT IMAGE-TYPE DIRECT POSITIVE SILVER HALIDE LIGHT-SENSITIVE MATERIAL

[75] Inventor: Ashita Murai, Kanagawa, Japan

[73] Assignee: Fuji Photo Film Co., Ltd., Kanagawa, Japan

[21] Appl. No.: 665,872

[22] Filed: Oct. 29, 1984

[30] Foreign Application Priority Data

Oct. 31, 1983 [JP] Japan ..... 58-204593

[51] Int. Cl.[4] ..... G03C 1/34

[52] U.S. Cl. ..... 430/230; 430/217; 430/218; 430/603; 430/611; 430/547; 430/940; 430/598; 430/599; 430/604; 430/605; 430/409; 430/410

[58] Field of Search ..... 430/603, 940, 598, 611, 430/230, 599, 604, 605, 409, 410, 217, 218, 547

[56] References Cited

U.S. PATENT DOCUMENTS

| | | | |
|---|---|---|---|
| 4,266,018 | 5/1981 | Ishiguro et al. | 430/611 |
| 4,284,717 | 8/1981 | Toya et al. | 430/603 |
| 4,431,730 | 2/1984 | Urabe et al. | 430/603 |
| 4,431,731 | 2/1984 | Sugimoto et al. | 430/603 |

*Primary Examiner*—Won H. Louie

*Attorney, Agent, or Firm*—Sughrue, Mion, Zinn, Macpeak, and Seas

[57] ABSTRACT

An internal latent image-type direct positive silver halide light-sensitive material is described, comprising a support having at least one photographic emulsion layer thereon, wherein said layer contains internal latent image-type direct positive silver halide grains, the surfaces of which are chemically sensitized, wherein a compound of the general formula (I) is added as a finish additive to the photographic emulsion layer or at least one hydrophilic colloid layer adjacent to the photographic emulsion layer.

General Formula (I):

wherein $R_1$, $R_2$ and $R_3$ are defined as herein.

The light-sensitive material exhibits a very satisfactory reversal performance and is greatly improved in stability over the course of time.

20 Claims, No Drawings

INTERNAL LATENT IMAGE-TYPE DIRECT POSITIVE SILVER HALIDE LIGHT-SENSITIVE MATERIAL

FIELD OF THE INVENTION

The present invention relates to an internal latent image-type silver halide light-sensitive material forming direct positive photographic images. More particularly, it is concerned with a surface chemical sensitized internal latent image-type direct positive silver halide light-sensitive material showing on outstanding reversal performance and greatly improved in stability over the course of time.

Surface chemical sensitized internal latent image-type direct positive silver halide emulsions are described in U.S. Pat. Nos. 3,317,322, 3,761,276, and Japanese Patent Application (OPI) No. 136641/82 (the term "OPI" as used herein means a "published unexamined Japanese patent application"). These emulsions are obtained by: (1) preparing core grains by doping the inside of silver halide grains with metallic ions, or chemical sensitizing them, or applying both doping and chemical sensitization: (2) depositing silver halide on the core grains so as to cover the light-sensitive sites thereof, thereby forming a shell: and (3) chemical sensitizing the surface of the grains. Internal latent image-type silver halide grains surface chemical sensitized by the above procedure are hereinafter referred to as "surface chemical sensitized core/shell type silver halide grains".

It is well known, as described in U.S. Pat. No. 3,761,276 and Japanese Patent Application (OPI) No. 136641/82, that when a photographic light-sensitive material comprising a support with an internal latent image-type direct positive silver halide emulsion coated thereon is imagewise exposed and, thereafter, is surface developed in the presence of nucleating agents or is subjected to a direct reversal treatment allowing for uniform exposure at the time of surface development, a reversal image can be obtained.

In chemical sensitization of the surface of such internal latent image-type silver halide grains, however, it is required for the surface chemical sensitization to be stopped at a suitable point in order to obtain a satisfactory reversal performance. Thus, the surface chemical sensitized nuclei have a disadvantage in that stability over the course of time is very poor.

Particularly in the case of core/shell type silver halide grains, surface chemical sensitization is applied to increase the maximum density (Dmax) of a reversal image to be obtained by a direct reversal treatment. If the surface chemical sensitization is increased to a certain extent, the Dmax of the reversal image increases progressively. If, however, the surface chemical sensitization is performed excessively beyond the optimum extent, various problems arise: for example, the Dmax of the reversal image increases, and the sensitivity of the reversal image drop. Furthermore, the chemical sensitization of the surface of core/shell type silver halide grains necessarily leads to an increase in the sensitivity of re-reversal images (negative images). If, however, the surface chemical sensitization is performed excessively, the sensitivity of re-reversal images is increased to a considerably high extent, thereby causing a problem that in areas of high light exposure amount a false image is formed.

Thus, in order to obtain a satisfactory reversal performance, as described above, the surface chemical sensitization of internal latent image-type silver halide grains should be stopped at a suitable point. The thus-formed surface chemical sensitized nuclei, however, are weak as compared with the surface chemical sensitized nuclei formed using the usual surface latent image-type silver halide grains producing a negative image and, therefore, are seriously poor in stability over the course of time.

When a photographic emulsion containing internal latent image-type silver halide grains which have been subjected to surface chemical sensitization to an extent that a satisfactory reversal performance can be obtained is coated on a support and the resulting light-sensitive material is stored under high temperature/high humidity conditions or stored at room temperature for long periods of time, changes in the performance, such as a reduction in the Dmax of the reversal image, occur, as a result in which the light-sensitive material becomes unsuitable for practical use.

In order to overcome the above problem, incorporation of well known stabilizers such as 4-hydroxy-6-methyl-1,3,3a,7-tetrazaindene and 1-phenyl-5-mercaptotetrazole have been employed. In order to prevent the change in performance over the course of time, however, it is necessary that such stabilizers be added in large amounts. Addition of such large amounts of stabilizers inevitably exerts adverse influences on the reversal performance. For example, the Dmax of a reversal image is decreased and also the re-reversal image sensitivity is increased under the action of the development inhibitor. Moreover, in spectral sensitization which is often applied to silver halide emulsions, the compounds interfere with adsorption of sensitizing dyes and prevent the increase of sensitivity in spectral sensitized areas.

SUMMARY OF THE INVENTION

An object of the present invention is to provide an internal latent image-type direct positive silver halide light-sensitive material showing a satisfactory reversal performance and furthermore improved in stability over the course of time.

Another object of the present invention is to provide a method of improving the stability over the course of time of a surface chemical sensitized internal latent image-type direct positive silver halide light-sensitive material without deteriorating the good reversal performance thereof.

Still another object of the present invention is to provide a method of improving the stability over the course of time of a surface chemical sensitized internal latent image-type direct positive silver halide light-sensitive material without interfering with the spectral sensitization of a surface chemical sensitized internal latent image-type direct positive silver halide emulsion through addition of a sensitizing dye.

It has been found that the above objects are attained by incorporating, as a finish additive, a sulfur-containing compound represented by the general formula (I) as described hereinafter, into a surface chemical sensitized internal latent image-type direct positive silver halide emulsion layer or into at least one hydrophilic colloid layer adjacent to the silver halide emulsion layer.

The present invention relates to an internal latent image-type direct positive silver halide light-sensitive material comprising a support having at least one photographic emulsion layer coated thereon, wherein said photographic emulsion layer contains internal latent image-type direct positive silver halide grains, the surfaces of which are chemically sensitized, wherein a compound represented by the general formula (I) as described hereinafter is added as a finish additive to the photographic emulsion layer or at least one hydrophilic colloid layer adjacent to the photographic emulsion layer.

DETAILED DESCRIPTION OF THE INVENTION

The term "finish additive" as used herein means a compound which is to be added during a suitable stage after the surface chemical sensitization of an internal latent image-type silver halide emulsion is completed, but before the silver halide emulsion is coated on a support.

It is preferred that the sulfur-containg compound of the general formula (I) as described hereinafter be added after a sensitizing dye is added and, furthermore, before coating of an emulsion.

The sulfur-containing compounds of the present invention are represented by the general formula (I):

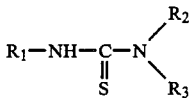

(I)

wherein:

$R_1$ is a saturated or unsaturated aliphatic radical, an aromatic radical, a nitrogen atom-containing 5- or 6-membered heterocyclic radical, or an acyl group;

$R_2$ is a hydrogen atom, a saturated or unsaturated aliphatic radical, or an aromatic radical;

$R_3$ is the same as $R_1$ or $R_2$;

$R_2$ and $R_3$ may combine together to form a heterocyclic ring; and $R_1$ to $R_3$ and the heterocyclic ring derived from $R_2$ and $R_3$ may be substituted, provided that when $R_2$ is an aromatic ring, it is not substituted by a group with at least hydrazine or its derivative bound thereto.

The aliphatic radical represented by $R_1$ and $R_2$ includes a straight or branched alkyl group which may be substituted, a cycloalkyl group which may be substituted, an alkenyl group, and an alkynyl group.

The straight or branched alkyl group is, for example, an alkyl group having from 1 to 10 carbon atoms and preferably from 1 to 5 carbon atoms. Representative examples are a methyl group, an ethyl group, an isobutyl group, and a tert-amyl group.

The cycloalkyl group contains, for example, from 3 to 6 carbon atoms. A representative example is cyclohexyl.

Substituents for the alkyl and cycloalkyl groups include an alkoxy group (e.g., a methoxy group, an ethoxy group, and a propoxy group), a hydroxyl group, a cyano group, a sulofnyl group, a carboxyl group, a halogen atom (e.g., chlorine, bromine, fluorine, and iodine), an aryl group (e.g., a phenyl group, a halogen-substituted phenyl group, and an alkyl-substituted phenyl group), and the like. Representative examples of such substituted alkyl and cycloalkyl groups are a 3-methoxypropyl group, a hydroxyethyl group, a cyanoethyl group, a 4-chlorocyclohexyl group, a benzyl group, and a carboxyamyl group.

The alkenyl group includes an allyl group, and the alkynyl group includes a propargyl group.

The acyl group may be aliphatic or aromatic, and its representative examples are an acetyl group and a benzoyl group.

The aromatic group represented by $R_1$ and $R_2$ includes a phenyl group and a substituted phenyl group. Substituents for the substituted phenyl group include an alkyl group (e.g., a methyl group and an ethyl group), an alkoxyl group (e.g., a methoxy group and an ethoxy group), a cyano group, a hydroxyl group, a carboxyl group, a nitro group, a sulfonyl group, a halogen atom, (e.g., chlorine, bromine, fluorine, and iodine), and the like. Representative examples of such substituted phenyl groups include a p-tolyl group, a p-methoxyphenyl group, and a p-chlorophenyl group.

The nitrogen atom-containing heterocyclic radical represented by $R_1$ includes a pyrroline ring, a pyridine ring, a quinoline ring, an indole ring, an oxazole ring, a benzooxazole ring, an imidazole ring, a benzoimidazole ring, a thiazoline ring, a thiazole ring, a benzothiazole ring, a selenazole ring, a benzoselenazole ring, a triazole ring, and a thiadiazole ring. These heterocyclic radicals may be substituted by an alkyl group (e.g., a methyl group and an ethyl group), an alkoxy group (e.g., a methoxy group and an ethoxy group), a halogen atom (e.g., chlorine, bromine, fluorine, and iodine), and the like.

$R_2$ and $R_3$ may combine together to form a heterocyclic ring. Examples of such heterocyclic rings are a morpholine ring, a piperidine ring, a piperazine ring, a pyrrolidine ring, and the like. These rings may be substituted by, for example, a hydroxyl group. However, $R_2$ does not include an aromatic ring having a substitutent bound by hydrozine or its derivatives. That is, for example, the following compound is not included in the compounds represented by the formula (I)

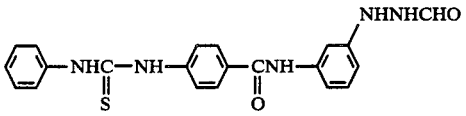

The substituents for $R_1$, $R_2$ and $R_3$ are not specifically restrictive, but, in practice, preferably have carbon numbers falling within a range that the compounds represented by the general formual (I) are shown below.

Typical examples of the compounds represented by the general formula (I) are shown below.

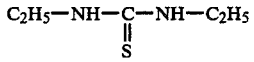

1.

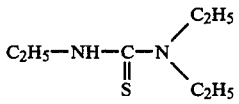

2.

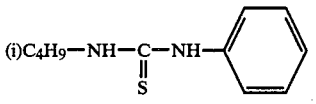

3.

-continued
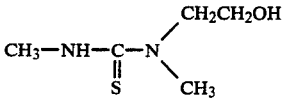
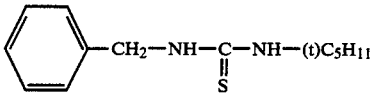
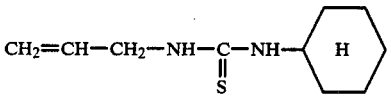
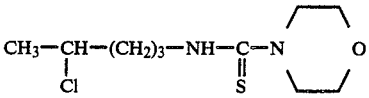
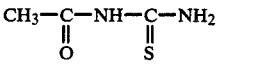
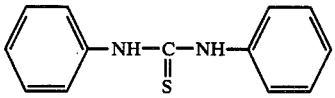
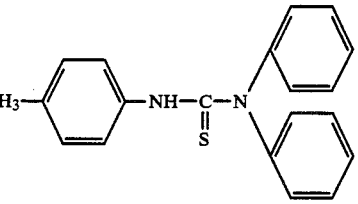
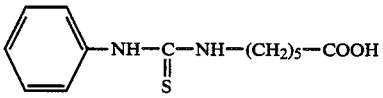
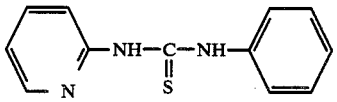
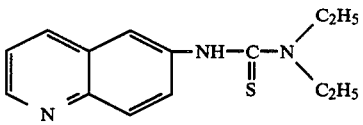
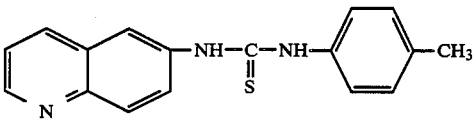
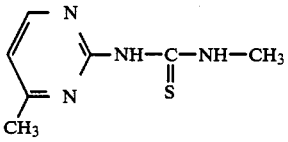
4.
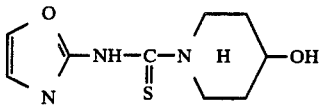
5.
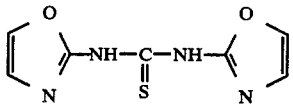
6.
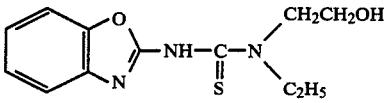
7.
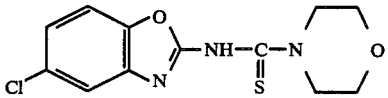
8.
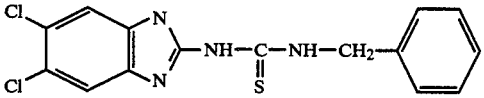
9.
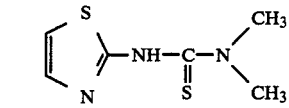
10.
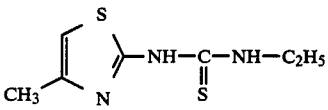
11.
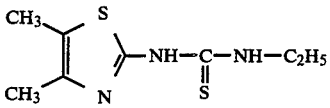
12.
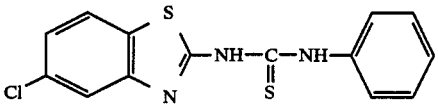
13.
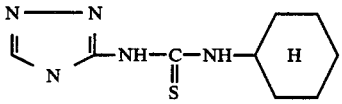
14.
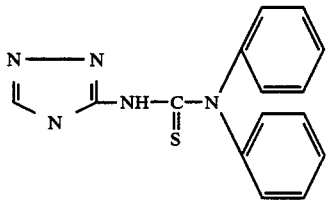
15.
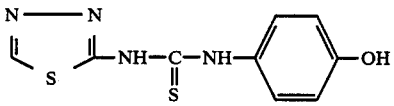
16.
17.
18.
19.
20.
21.
22.
23.
24.
25.
26.
27.

-continued

28.

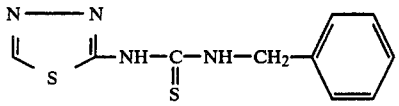

29.

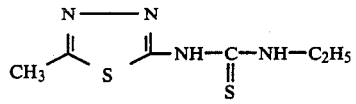

30.

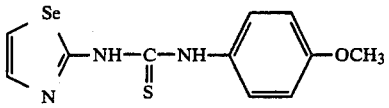

31.

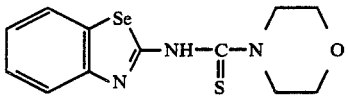

Although in a preferred embodiment of the present invention the compound of the general formula (I) is incorporated in a surface chemical sensitized internal latent image-type silver halide emulsion layer, it may be added to a hydrophilic colloid layer adjacent to the above emulsion layer. This hydrophilic colloid layer may be any of an intermediate layer, a filter layer, a protective layer, a light reflective layer, and so forth irrespective of its function as long as it does not interfere with diffusion of the compound of the general formula (I) onto the surface of internal latent image-type silver halide grains.

When the compound of the general formula (I) is incorporated in the surface chemical sensitized internal latent image-type silver halide emulsion, the amount of the compound to be added to be practically sufficient is from about $5\times10^{-7}$ to $1\times10^{-4}$ mole per mole of silver in the emulsion and preferably from about $1\times10^{-6}$ to $5\times10^{-5}$ mole per mole of silver in the emulsion. When the compound is incorporated in an adjacent hydrophilic colloid layer, it is sufficient to be added in the same amount as above based on the amount of silver contained in the same area of the internal latent image-type emulsion. That is, the amount of the compound of the general formula (I) being added is less than about 1/100 of the commonly used amount of known stabilizers. This demonstrates that the compounds of the general formula (I) are very effective in improving the stability over the course of time even if used in very small amounts. In spectral sensitization through addition of sensitizing dyes, therefore, the compounds of the general formula (I) do not interfere with adsorption of the sensitizing dyes and permit efficient spectral sensitization.

The term "internal latent image-type silver halide emulsion" as used herein means an emulsion in which the maximum density obtained when development is performed using an "internal-type" developer is greater than that obtained when development is performed using a "surface-type" developer. More specifically, it means that the maximum density, as determined by the usual photographic denisty-measuring method, of a silver halide emulsion which is coated in a layer form on a transparent support, exposed to light for a predetermined time of from 0.01 to 1 second, and then developed at 20° C. for 3 minutes in a developer A (internal-type developer) as described hereinafter, is at least five times greater than that of the silver halide emulsion which is exposed to light in the same manner as above and then developed at 20° C. for 4 minutes in a developer B (surface-type developer) as described hereinafter. The usual photographic density-measuring method means a method to measure a transmission density using an optical system by which "diffuse density", especially "specular-diffuse density" is measured. For measuring the photographic density, for example, TCD-S type densitometer made by Fuji Photo Film Co., Ltd. is used.

Developer A

| | |
|---|---|
| Hydroquinone | 15 g |
| Monomethyl-p-aminophenol sesquisulfate | 15 g |
| Sodium sulfite | 50 g |
| Potassium bromide | 10 g |
| Potassium hydroxide | 25 g |
| Sodium thiosulfate | 20 g |
| Water to make | 1 liter |

Developer B

| | |
|---|---|
| p-Oxyphenylglycine | 10 g |
| Sodium carbonate | 100 g |
| Water to make | 1 liter |

Internal latent image-type silver halide emulsions include:

a conversion emulsion (as described in, for example, U.S. Pat. No. 2,592,250) which is prepared by a procedure involving converting grains of high solubility silver salts, such as silver chloride, into low solubility silver salts, such as silver bromide or iodobromide (catastrophe precipitation method);

a core/shell emulsion (as described in, for example, U.S. Pat. No. 3,206,313) in which core grains are covered with a shell of silver halide by a procedure comprising adding an emulsion of finely pulverized grains to a core emulsion of large chemically sensitized grains and then ripening the resulting mixture;

a core/shell emulsion (as described in, for example, British Pat. No. 1,027,146 and U.S. Pat. No. 3,761,276) in which core grains are covered with a shell of silver halide by a procedure comprising adding a soluble silver salt solution and a soluble halide solution at the same time to a chemically sensitized core emulsion of mono-dispersion while maintaining the silver ion concentration at a constant level;

a core/shell emulsion in which core grains of silver halide, the inside of the grains being doped with metallic ions, are covered with a shell of silver halide through deposition;

a halogen-localized emulsion (as described in, for example U.S. Pat. No. 3,935,014) in which emulsion particles are of the structure that at least two layers are laminated, the halogen composition of the first layer being different from that of the second layer; and an emulsion (as described in, for example, U.S. Pat. No. 3,447,927) in which silver halide grains are allowed to grow in an acidic medium containing trivalent metallic ions so that they contain different metals.

In addition, internal latent image-type emulsions as described in E. J. Wall, *Photographic Emulsion,* published by Americal Photographic Publishing Co., (1929), pages 35 to 36 and 52 to 53, U.S. Pat. Nos.

2,497,875, 2,563,785, 3,511,662, 4,395,478, and West German Patent Application (OLS) No. 2,728,108 are included.

Of the above-described internal latent image-type emulsions, the core/shell type emulsions are particularly preferred to use in the present invention.

That is, the surface chemical sensitized internal latent image-type silver halide emulsion, which is preferably used in the present invention, is obtained by first preparing silver halide internal nuclei (core grains) doped with metallic ions, or chemically sensitized, or subjected to both the doping and chemical sensitization, then covering the surface of the core grains with a shell of silver halide, and finally applying the optimum degree of surface chemical sensitization on to the surface of the resulting silver halide grains.

The term "optimum degree of surface chemical sensitization" as used herein means that the chemical sensitization is applied in the state that the Dmax of a reversal image, the Dmin of the reversal image, the sensitivity of the reversal image, and the sensitivity of a re-reversal image (negative image) are most well balanced.

Doping of the internal nucleus of silver halide with metallic ions can be carried out, for example, by a procedure in which in the course of formation of a silver halide grain as the internal nuclei or its physical ripening a metallic ion source, such as a cadmium salt, a zinc salt, a lead salt, a thallium salt, an erbium salt, a bismuth salt, an irridium salt or its complex salt, a rhodium salt or its complex salt, and an iron salt or its complex salt, is allowed to coexist. The metal ion is usually added in a proportion of at least $10^{-6}$ mole per mole of silver halide. The silver halide grain as the internal nuclei may be chemically sensitized using at least one of a noble metal sensitizer, a sulfur sensitizer, and a reduction sensitizer with or without application of the doping with metallic ions. In particular, core/shell type silver halide grains, which are prepared by applying gold sensitization and sulfur sensitization on to the surface of silver halide grains as the internal nuclei, covering the surface with a shell, and then further applying surface chemical sensitization, have a good reversal performance.

The ratio of the amount of silver halide used as the internal nucleus to that of silver halide used as the shell is not critical. However, it is sufficient for the shell to be applied so that at least light-sensitive sites (where light-decomposed silver is formed as a result of light-exposure) of the internal nuclues are covered with the shell. Thus, the amount of silver halide as the shell is usually from 0.1 to 10 moles, preferably from 1 to 8 moles per mole of silver halide as the internal nucleus.

It is preferred that the composition of silver halide constituting the internal nucleus be the same as that of silver halide constituting the shell. They may have, of course, different compositions. Silver halide which can be used include silver bromide, silver iodide, silver chloride, silver chlorobromide, silver bromoiodide, and silver chlorobromoidide. Preferably the silver halide emulsion is composed of at least 50 mole% of silver bromide. It is most preferred that the silver halide emulsion be composed of silver bromide or silver bromoiodide (in particular, the one containing not more than 10 mole% of silver iodide).

Core/shell type silver halide grains having various grain sizes can be used in the present invention. Good results can be obtained using core/shell type silver halide grains having an average grain diameter of from 0.1 to 4 microns and preferably from 0.2 to 3 microns.

These core/shell type silver halide grains may have a regular crystal form, such as cubic and octahedral forms, or an irregular crystal form, such as spherical and platelike forms, or composite crystal forms thereof, or they may be composed of grains having various crystal forms. As platelike grains, those grains having an aspect ratio of at least 5, especially at least 8 can be used (as described in, for example, Japanese Patent Application (OPI) No. 108528/83).

The surface chemical sensitization can be achieved by applying, singly or in combination with each other, sulfur sensitization using sulfur-containing compounds capable of reacting with silver ions or active gelatin, reduction sensitization using reducing substances, noble metal sensitization using noble metal (e.g., gold) compounds, and so forth. The surface chemical sensitization can be carried out, as described in Japanese Patent Application (OPI) No. 136641/82, in the presence of polymers having a repeating unit represented by the general formula (II) as described below. A typical example of such polymers is poly(N-vinyl)pyrrolidone.

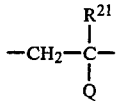

(II)

wherein:

$R^{21}$ is a hydrogen atom or an alkyl group; and

Q is any one of the following groups (1) to (4):

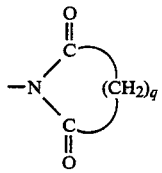

(1)

(wherein q is an integer of from 2 to 4).

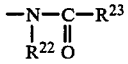

(2)

(wherein $R^{22}$ and $R^{23}$ are each a hydrogen atom or an alkyl group).

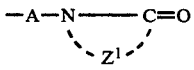

(3)

(wherein $Z^1$ is an atomic group necessary for forming a lactam ring, an oxazolidone ring, or a pyridone ring, and A is merely a bonding group, or a group

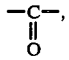

or a group

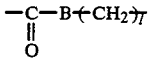

(wherein B is a group —O—, or a group

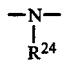

(wherein $R^{24}$ is a hydrogen atom or an alkyl group), and l is an integer of from 1 to 6)).

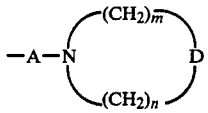

(4)

(wherein A is the same as defined in (3) above, D is merely a bonding group, or a group —O—, or a group

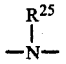

(wherein $R^{25}$ is a hydrogen atom, an alkyl group, or a group

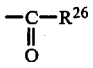

(wherein $R^{26}$ is an alkyl group), and m and n are each an integer of from 1 to 6, provided that m+n=4 to 7).

Conditions under which the surface chemical sensitization is carried out are not critical. In general, it is preferably carried out under conditions of pH 9 or less, a pAg of 11 or less, and a temperature of 50° C. or more. In some cases, it may be carried out under conditions of 50° C. or more. In some cases, it may be carried out under conditions not falling within the above-defined ranges. For example, even under conditions within the above-defined ranges in pH and pAg, but not falling willing the above-defined ranges in a temperature, the chemical sensitization may be carried out.

Reducing substances which can be used in the reduction sensitizing method include stannous salts, amines, hydrazine derivatives, formamidinesulfunic acid, anf silane compounds. Noble metal compounds which can be used include the complex salts of Group VIII metals (e.g., Pt, Ir, and Pd) of the Periodic Table.

Of the above chemical sensitization methods, the sulfur sensitization method using sulfur sensitizers provides the most satisfactory reversal performance. The reversal performance can further be increased by performing the sulfur sensitization in the presence of the above-described polymers such as poly(N-vinyl)pyrrolidone. In some cases, sulfur sensitizers may be used in combination with complex salts of gold.

Sulfur sensitizers include thiosulfuric acid salts, thioureas, thiazoles, and rhodanines. Representative examples are described in U.S. Pat. Nos. 1,574,944, 2,410,689, 2,278,947, 2,728,668, 3,656,955, and Japanese Patent Application (OPI) No. 45016/80.

The compounds of the general formula (I) may be classified into thioureas in view of their chemical structures. The present invention, however, is characterized in that the surface chemical sensitization is carried out in the absence of the compounds of the general formula (I) (although the compounds of the general formula (I) may be used as sulfur sensitizers in the surface chemical sensitization, they are decomposed on reacting with silver ions on the surface of internal latent image-type silver halide grains, thereby failing to serve as stabilizers), and that the compounds of the general formula (I) are incorporated in the light-sensitive material in the state that they are not decomposed, by adding them during any suitable stage after the surface chemical sensitization is completed, but before the photographic emulsion containing the surface chemical sensitized internal latent image-type silverhalide grains is coated on the support, or by adding to at least one of other hydrophilic colloid layers adjacent to the surface chemical sensitized internal latent image-type silver halide emulsion layer. An internal latent image-type silver halide light-sensitive material which is prepared by using the compounds of the general formula (I) as sulfur sensitizers in the surface chemical sensitization and by performing the surface chemical sensitization almost to the optimum extent is considerably poor in stability over the course of time; that is, the stability over the course of time cannot be increased unless the compounds of the general formula (I) are added as final additives. This will be demonstrated with reference to the example as described hereinafter.

Satisfactory stability over the course of time can be obtained by using the compounds of the general formula (I), singly or in combination with each other.

In the direct positive photographic light-sensitive material of the present invention, the compounds of the general formula (I) may be present along with other compounds to be added for the purpose of preventing a reduction in the sensitivity of a reversal image or the formation of fog during the production, storage or processing of the light-sensitive material.

Compounds to be added for this purpose include azoles such as benzothiazolium salts, nitroindazoles, triazoles, benzotriazoles, and benzimidazoles (particularly nitro- or halogen-substituted compounds); heterocyclic mercapto compounds such as mercaptothiazoles, mercaptobenzothiazoles, mercaptobenzimidazoles, mercaptothiadiazoles, mercaptotetrazoles (particularly 1-phenyl-5-mercaptotetrazole), and mercaptopyrimidines; the above heterocyclic mercapto compounds further having a water-soluble group such as a carboxyl group and a sulfon group; thioketone compounds such as oxazolinethione; azaindenes such as tetrazaindenes (particularly 4-hydroxy-substituted (1,3,3a,7)tetrazaindenes); benzenethiosulfonic acids; benzenesulfinic acid; and other many compounds known as antifoggants or stabilizers.

Compounds which are preferably used as antifoggants or stabilizers in combination with the compounds of the general formula (I) include 4-hydroxy-6-methyl-1,3,3a,7-tetrazaindene, 5-mercapto-1-phenyltetrazole, and 3-methylbenzothiazole.

In the light-sensitive material of the present invention, the surface chemical sensitized internal latent image-type silver halide emulsion may be spectral sensitized to relatively longer wavelength light of blue light, green light, red light or infrared light, using sensitizing dyes. Sensitizing dyes which can be used include cyanine dyes, merocyanine dyes, composite cyanine dyes, compositie merocyanine dyes, holopolar cyanine dyes, hemicyanine dyes, styryl dyes, and hemioxonol dyes. Of these dyes, those dyes belonging to the cyanine, merocyanine and composite merocyanine dyes are preferably used in combination with the compounds of the general formula (I). In these dyes, any nuclei usually utilized as basic heterocyclic nuclei in the cyanine dyes can be applied. That is, a pyrroline nucleus, an oxazoline nucleus, a thiazoline nucleus, a pyrrole nucleus, an oxazole nucleus, a thiazole nucleus, a senalenazole nucleus, an imidazole nucleus, a tetrazole nucleus, and a pyridine nucleus; nucleis resulting from the fusion of alicyclic hydrocarbon rings to the above nuclei; and nuclei resulting from the fusion of aromatic hydrocarbon rings to the above nuclei, such as an indolenine nucleus, a benzindolenine nucleus, an indole nucleus, a benzoxazole nucleus, a naphthooxazole nucleus, a benzothiazole nucleus, a naphthothiazole nucleus, a benzoselenazole nucleus, a benzimidazole nucleus, and quinoline nucleus, can be applied. These nuclei may be substituted in the carbon atom.

In merocyanine dyes or composite merocyanine dyes, as nuclei having the ketomethylene structure, 5- to 6-membered heterocyclic nuclei such as a pyrazoline-5-one nucleus, a thiohydantoin nucleus, a 2-thiooxazolizine-2,4-dione nucleus, a thiazolidine-2,4-dione nucleus, a rhodanine nucleus, and a thiovarbituric acid nucleus can be applied.

Useful sensitizing dyes are described in, for example, German Pat. No. 929,080, U.S. Pat. Nos. 2,231,658, 2,493,748, 2,503,776, 2,519,001, 2,912,329, 3,655,394, 3,656,959, 3,672,897, 3,694,217, British Pat. No. 1,242,588, and Japanese Patent Publication No. 14030/69.

These sensitizing dyes may be used singly or in combination with each other. Combinations of sensitizing dyes are often used for the purpose of super sensitization. Typical examples are described in U.S. Pat. Nos. 2,688,545, 2,977,229, 3,397,060, 3,522,052, 3,527,641, 3,617,293, 3,628,964, 3,666,480, 3,679,428, 3,703,377, 3,769,301, 3,814,609, 3,837,862, British Pat. No. 1,344,281, and Japanese Patent Publication No. 4936/68.

Along with these sensitizing dyes, dyes not having a spectral sensitization action by themselves, or substances substantially not absorbing visible light and showing super sensitization can be incorporated in the emulsion. For example, aminostilbene compounds substituted by a nitrogen-containing heterocyclic group (as described in, for example, U.S. Pat. Nos. 2,933,390 and 3,635,721), aromatic organic acid/formaldehyde condensates (as described in, for example, U.S. Pat. No. 3,743,510), and so forth may be incorporated. Particularly useful are those combinations as described in U.S. Pat. Nos. 3,615,613, 3,615,641, 3,617,295, and 3,635,721.

In the surface chemical sensitized internal latent image-type silver halide light-sensitive material of the present invention is formed a reversal image by developing in the presence of a nucleating agent or by uniformly applying the exposure at the time of surface development.

Typical examples of such nucleating agents are hydrazines as described in U.S. Pat. Nos. 2,563,785 and 2,588,982, hydrazines and hydrazones as described in U.S. Pat. No. 3,227,552, heterocyclic quaternary salt compounds as described in British Pat. No. 1,283,825, Japanese Patent Application (OPI) No. 69613/77, U.S. Pat. Nos. 3,615,615, 3,719,494, 3,734,738, 4,094,683, and 4,115,122, sensitizing dyes having a nucleating substituent in the dye molecule as described in U.S. Pat. No. 3,718,470, thiourea bond-type acylhydrazine compounds as described in U.S. Pat. No. 4,030,925, 4,031,127, 4,245,037, 4,255,511, 4,266,013, 4,276,364, and British Patent 2,012,443, and acylhydrazine compounds having as an adsorption group a thioamide ring or a heterocyclic group such as triazole and tetrazole as described in U.S. Pat. Nos. 4,080,270, 4,278,748, and British Pat. No. 2,011,391 B.

It is desirable for the nucleating agent to be added in such an amount that the internal latent image-type emulsion, when developed with a surface developer, provides a sufficiently high maximum density. In practice, the optimum nucleating agent content varies over a wide range depending on the characteristics of the silver halide emulsion, the chemical structure of the nucleating agent, and the developing conditions. When the nucleating agent is added to a developer, it is generally added in an amount of from about 0.01 to 5 g, preferably from about 0.05 to 1 g per liter of the developer. When, on the other hand, the nucleating agent is added to an emulsion layer, it is useful to be added in an amount of from about 0.1 mg to 5 g per mole of silver in the internal latent image-type silver halide emulsion, with the rainge of from about 0.5 mg to 2 g per mole of silver being preferred. When the nucleating agent is added to a hydrophilic colloid layer adjacent to the emulsion layer, it is sufficient to be added in the same amount as above based on the weight of silver contained in an internal latent image-type emulsion of the same area.

The photographic emulsion layer and other hydrophilic colloid layers of the light-sensitive material of the present invention may contain various surfactants as coating aids or for various purposes of, e.g., preventing charging, improving sliding properties, improving emulsification and dispersion, preventing adhesion and improving photographic characteristics (such as acceleration of development, increase of contrast, and sensitization). Surfactants which can be used in combination with the compounds of the general formula (I) include:

nonionic surfactants such as saponin (steroid-based), alkyleneoxide derivatives (e.g., polyethylene glycol, a polyethylene glycol/polypropylene glycon condensate, polyethylene glycol alkyl ethers or alkylaryl ethers, polyethylene glycol esters, polyethylene glycol sorbitan esters, polyalkylene glycol alkylamine or amides, and a silicone/polyethylene oxide adduct), glycidol derivatives (e.g., alkenylsuccinic acid polyglyceride, and alkylphenyl polyglyceride), fatty acid esters of polyhydric alcohols, and alkyl esters of saccharides;

anionic surfactants containing an acid group, such as a carboxyl group, a sulfo group, a phospho group, a sulfate group, and a phosphate group, such as alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurins, sulfosuccinic acid esters, sulfoalkylpolyoxyethylene alkylpheny ethers, and polyoxyethylene alkylphosphoric acid esters;

amphoteric surfactants such as amino acids, aminoalkylsulfonic acids, aminoalkylsulfuric acid or phosphoric acid esters, alkylbetaines, and amineoxides; and cationic surfactants such as alkylamine salts, aliphatic or aromatic quaternary ammonium salts, heterocyclic quaternary ammonium salts (e.g., pyridinium and imidazolium), and phosphonium or sulfonium salts containing an aliphatic or heterocyclic ring.

As a binder or protective colloid for use in the photographic emulsion layer or other hydrophilic colloid layers of the light-sensitive material of the present invention, it is advantageous to employ gelatin. Other hydrophilic colloids can also be used. For example, gelatin derivatives, graft polymers of gelatin and other polymers, and proteins such as albumin and casein; cellulose derivatives such as hydroxyethyl cellulose, carboxymethyl cellulose, and cellulose sulfuric acid esters; sugar derivatives such as sodium alginate and starch derivatives; and various synthetic hydrophilic polymers, homopolymers or copolymers, such as polyvinyl alcohol, polyvinyl alcohol partial acetal, poly(N-vinyl)pyrrolidone, polyacrylic acid, polymethacrylic acid, polyacrylamide, polyvinyl imidazole, and polyvinyl pyrazole can be used.

The gelatin, as well as lime-treated gelatin, acid-treated gelatin, and enzyme-treated gelatin as described in *Bull. Soc. Sci. Phot. Japan,* No. 16, page 30 (1966) may be used. In addition, compounds resulting from decomposition of gelatin by hydrolysis or with enzymes can be used.

Gelatin derivatives which can be used include those compounds prepared by reacting gelatin with compounds such as acid halides, acid anhydrides, isocyanates, bromoacetic acid, alkanesultones, vinylsulfonamides, maleinimides, polyalkylene oxides, and epoxy compounds. Representative examples of these gelatin derivatives are described in U.S. Pat. Nos. 2,614,928, 3,132,945, 3,186,846, 3,312,553, British Pat. Nos. 861,414, 1,033,189, 1,005,784, and Japanese Patent Publication No. 26845/67.

Gelatin graft polymers prepared by grafting on to gelatin homo- or co-polymers of vinyl monomers such as acrylic acid, methacrylic acid and their derivatives (e.g., esters and amides), acrylonitrile, and styrene can be used. Especially preferred are those graft polymers prepared using polymers compatible to a certain extent with gelatin, such as polymers of, e.g., acrylic acid, methacrylic acid, acrylamide, methacrylamide, and hydroxyalkyl methacrylate. Examples of these gelatin graft polymers are described in U.S. Pat. Nos. 2,763,625, 2,831,767, and 2,956,884.

Typical synthetic hydrophilic polymers are described in, for example, West German Patent Application (OLS) No. 2,312,708, U.S. Pat. Nos. 3,620,751, 3,879,205, and Japanese Patent Publication No. 7561/68. The photographic emulsion layer, for example, may contain, for the purpose of, e.g., facilitating passage of the processing solution therethrough, inert particles which are substantially incapable of swelling in aqueous alkalis, are compatible with gelatin and, furthermore, do not substantially form a film. A preferred example is a polymer latex. Polymer latexes which can be used include latexes of homo- or co-polymers of acrylic acid or methacrylic acid, and homo- or co-polymers of styrene.

The light-sensitive material of the present invention is useful as a black and white light-sensitive material and also as a color light-sensitive material. When the light-sensitive material of the present invention is used as a color light-sensitive material, various dye image-forming compounds (hereinafter referred to as "coloring matters") can be used. With regard to couplers of coloring matters which can be used in the light-sensitive material of the present invention, the following can be used.

Representative examples of magenta couplers which can be used are described in, for example, U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Pat. No. 1,810,464, West German Patent Application (OLS) Nos. 2,408,665, 2,417,945, 2,418,959, 2,424,,467, Japanese Patent Publication Nos. 6031/65, 58922/77, 129538/74, 74027/74, 159336/75, 42121/77, 74028/74, 60233/75, 26541/76, and 55122/78.

Representative examples of yellow dye-forming couplers which can be used are described in, for example, U.S. Pat. Nos. 2,875,057, 3,265,506, 3,408,194, 3,551,155, 3,582,322, 3,725,072, 3,891,445, West German Pat. No. 1,547,868, West German Patent Application Laid-Open Nos. 2,219,917, 2,261,361, 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77, and 115219/77.

Representative examples of cyan couplers are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, West German Patent Application (OLS) Nos. 2,414,830, 2,454,329, Japanese Patent Application (OPI) Nos. 59838/73, 26034/76, 5055/73, 146828/76, 69624/77, and 90932/77.

When the light-sensitive material of the present invention is used as a color diffusion transfer light-sensitive material, dye developers can be used as coloring matters. It is advantageous to use coloring materials of the type that are undiffusible or are incapable of migrating in alkaline developers by themselves, but release a diffusible dye or its precursor as a result of development. These diffusible dye-releasing coloring materials include couplers and redox compounds, releasing a diffusible dye, and are useful as coloring materials not only for the color diffusion transfer process (wet system) but also for the heat development process (dry system).

Diffusible dye-releasing redox compounds (hereinafter referred to as "DRR compounds") can be represented by the following general formula:

$$Y—D$$

wherein Y represents a redox center having a function of releasing a diffusible dye as a result of development and is usually provided with a ballast group for immobilization of the compound, and D represents a dye or its precursor portion which is linked to the redox center through a connecting group.

Representative examples of the redox center of Y are described in, for example, U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,278,750, 4,135,929, 4,336,322, 4,139,389, Japanese Patent Application (OPI) Nos. 50736/78, 104343/76, 130122/79, 110827/78, 12642/81, 16131/81, 4043/82, 650/82, 20735/82, 69033/78, and 130927/79.

Representative examples of the dye portion of D are as follows.

Yellow Dye:

Dyes as described in U.S. Pat. Nos. 3,597,200, 3,309,199, 4,013,633, 4,245,028, 4,156,609, 4,139,383, 4,195,992, 4,148,641, 4,148,643, 4,336,322, Japanese Patent Application (OPI) Nos. 114930/76, 71072/81, and *Research Disclosure,* 17630 (1978) and ibid, 16,475 (1977).

Magent Dye:

Dyes as described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, 4,287,292, Japanese Patent Application (OPI) Nos. 106727/77, 106727/77, 23628/78, 36804/80, 73057/81, 71060/81, and 134/80.

Dye Dye:

Dyes as described in U.S. Pat. Nos. 3,482,972, 3,929,760, 4,013,635, 4,268,625, 4,171,220, 4,242,435, 4,142,891, 4,195,994, 4,147,544, 4,148,642, British Pat. No. 1,551,138, Japanese Patent Application (OPI) Nos. 99431/79, 8827/77, 47823/78, 143323/78, 99431/79, 71061/81, European Patent (EPC) Nos. 53,037, 53,040, and *Research Disclosure,* 17,630 (1978) and ibid, 16,475 (1977).

In general, the amount of the DRR compound coated is from about $1\times10^{-4}$ to $1\times10^{-2}$ mole/m$^2$ and preferably from about $2\times10^{-4}$ to $2\times10^{-2}$ mole/m$^2$.

In the preparation of the light-sensitive material of the present invention, various photographic supports can be used. The silver halide emulsion can be coated on one side or both sides of the support.

In the present invention, compounds releasing iodine ions, such as potassium iodide, can be incorporated in the silver halide emulsion. Also, by using developers containing iodine ions, the desired image can be obtained.

Alkaline processing compositions (developers) which can be used in the present invention may contain as preservatives compound such as sodium sulfite, potassium sulfite, ascoribic acid, and reductones (e.g., piperidinohexose reductone).

Developers may contain as alkali agents and buffers sodium hydroxide, potassium hydroxide, sodium carbonate, potassium carbonate, trisodium phosphate, sodium metaborate, and the like. These agents are added in such amounts as to adjust pH to from 10 to 14 and preferably from 12 to 14. It is advantageous that the developer contain color development accelerators, such as benzyl alcohol, and as agents to more lower the minimum density of the direct positive image, compounds commonly used as antifoggants, such as benzimidazoles (e.g., 5-nitrobenzimidazole) and benzotriazoles (e.g., benzotriazole and 5-methyl-benzotriazole).

The light-sensitive material of the present invention can be developed with known developing agents. These known developing agents include polyhydroxybenzenes, such as hydroquinone, 2-chlorohydroquinone, 2-methylhydroquinone, catechol, and pyrogallol; aminophenols, such as p-aminophenol, N-methyl-p-aminophenol, and 2,4-diaminophenol; 3-pyrazolidones, such as 1-phenyl-3-pyrazolidone, 4,4-dimethyl-1-phenyl-3-pyrazolidone, 4,4-dihydroxymethyl-1-phenyl-3-pyrazolidone, 4-methyl-4-hydroxymethyl-1-phenyl-3-pyrazolidone, and 4-methyl-4-hydroxymethyl-1-p-tolyl-3-pyrazolidone; and ascrobic acids. These compounds can be used singly or in combination with each other. In obtaining dye images with dye-forming couplers, aromatic primary amine developing agents, preferably p-phenylenediamine developing agents can be used. Representative examples are 4-amino-3-methyl-N,N-diethylaniline hydrochloride, N,N-diethyl-p-phenylenediamine, 3-methyl-4-amino-N-ethyl-N-β-(methanesulfoamido)ethylaniline, 3-methyl-4-amino-N-ethyl-N-(β-sulfoethyl)aniline, 3-ethoxy-4-amino-N-ethyl-N-(β-sulfoethyl)aniline, and 4-amino-N-ethyl-N-(β-hydroxyethyl)aniline. These developing agents may be incorporated in an alkaline processing composition (a processing element) or in a suitable layer of the light-sensitive material.

When DRR compounds are used as coloring matters in the present invention, any silver halide developing agents or electron donors can be used as long as they are capable of cross oxidizing the DRR compounds. Particularly preferred are 3-pyrazolidones.

When the light-sensitive material of the present invention is used as a color diffusion transfer film unit, it is preferred that the light-sensitive material be treated with viscous developers. These viscous developers are liquid compositions containing ingredients necessary for development of the silver halide emulsion and for formation of diffusion transfer dye images. They are composed mainly of water and, in some times, contain hydrophilic solvents such as methanol and methyl cellosolve.

The processing composition contains a sufficient amount of alkali to maintain the pH at a level necessary for causing development of the emulsion layer and also to neutralizing acids such as hydrohalogenic acids (e.g., hydrobromic acid) and carboxylic acids (e.g., acetic acid) as formed during the development and formation of dye images. Alkalis which can be used include alkali metal or alkaline earth metal salts and amines. Examples are lithium hydroxide, sodium hydroxide, potassium hydroxide, a calcium hydroxide dispersion, tetramethylammonium hydroxide, sodium carbonate, trisodium phosphate, and diethylamine. It is preferred that the processing composition contain caustic soda in such a concentration that the pH at room temperature is about 12 or more and especially about 14 or more. More preferably, the processing composition contains hydrophilic polymers such as high molecular weight polyvinyl alcohol, hydroxyethyl cellulose, and sodium carboxymethyl cellulose. These polymers are added in such an amount that the viscosity of the resulting processing composition as determined at room temperature is at least 1 poise and preferably from about 500 to 1,000 poises.

Particularly in the case of a mono sheet-type film unit, it is advantageous that the processing composition further contain carbon black as a light-shielding agent for preventing the formation of fog in the silver halide emulsion due to light from the outside during the processing or after the processing, light-absorbing substances such as pH-indicators, and desensitizing agents as described in U.S. Pat. No. 3,579,333. The processing composition may further contain development inhibitors such as benzotriazole.

It is preferred for the above processing composition to be used in the state that it is contained in breakable containers as described in U.S. Pat. Nos. 2,543,181, 2,643,886, 2,653,732, 2,723,051, 3,056,491, 3,056,492, and 3,152,515.

A color photograph can be obtained by processing the light-sensitive material of the present invention according to, for example, the following sequence of steps.

A light-sensitive material (or a light-sensitive element) comprising a support having coated thereon a photographic emulsion layer and, if desired, other hydrophilic colloid layers, said photographic emulsion layer containing in combination with at least one coloring material, internal latent image-type direct positive silver halide grains the surface of which have been subjected to chemical sensitization, is imagewise exposed. At least one of the photographic emulsion layer and other hydrophilic colloid layers contains the compound of the general formula (I).

The light-sensitive material is then developed by processing with an alkaline processing composition in the presence of a developer (an electron transfer agent), or by applying heat. As a result of development of the silver halide emulsion, a dye image is formed.

When the light-sensitive material of the present invention is used in the color diffusion transfer process, it is processed as follows.

(a) A distribution of diffusible dye constituting an image is formed.

(b) Then, at least part of the dye is diffused or transferred to an image-receiving layer (or an image-receiving element).

Thus, a diffusion transfer color image is formed in the image-receiving layer.

According to the same procedure as above, a color photograph can also be obtained utilizing a dye which remains in the light-sensitive material or light-sensitive element.

That is, at step (b) above, all of the diffusible dye is removed by techniques such as washing with water or diffusion transfer, or the remaining silver or silver halide is removed by applying bleaching and fixation, separately or at the same time, whereupon there can be obtained a color image composed of an undiffusible dye or coloring material remaining in the light-sensitive material.

The light-sensitive material of the present invention, in an embodiment of the present invention, is a light-sensitive element (1) comprising a support and at least one silver halide emulsion layer coated on the support. An embodiment in which the light-sensitive element (1) is combined with an image-receiving element (or an image-receiving layer) (2) is included in the scope of the present invention. In addition, an embodiment in which the light-sensitive element (1), and the image-receiving element (2) are further combined with a processing composition-supplying means (3) is also included in the scope of the present invention.

In the last embodiment in which elements (1), (2) and (3) are combined together, an example of the processing composition-supplying means is a pod which contains the processing composition and can be broken by application of pressure. This pod is arranged so that upon application of pressure by means of a pressing member, the contents (processing composition) of the pod is supplied between, for example, the light-sensitive layer and a cover sheet, or the light-sensitive layer and the image-receiving layer.

The above image-receiving element may be provided on another support so that it, after imagewise exposure, can be superposed on the light-sensitive element. This embodiment is described in, for example, U.S. Pat. No. 3,362,819. Moreover the image-receiving element may be superposed in the light-sensitive element over all the period from before light-exposure to after light-exposure.

As another embodiment, the image-receiving element may be provided on the same support as that on which the light-sensitive element is provided. This embodiment (i.e., a film unit) is described in, for example, Belgian Pat. No. 757,960. A still modified embodiment is described in Belgian Pat. No. 757,959. In accordance with this embodiment, the support is transparent, an image-receiving layer, a light-reflective layer (a white layer), a light-shielding layer, and a light-sensitive element are coated on the support, and a breakable pod containing an alkaline processing composition and a light-shielding agent is arranged between the uppermost layer (protective layer) and a transparent cover sheet (on which a neutralizing layer and a timing layer are coated). This film unit is placed in a camera, exposed to light through the transparent cover sheet, and then, when the film unit is taken out of the camera, it is passed through a pair of pressure-applying members. When the pod is broken by the pressure-applying members, it allows the processing composition and light-shielding agent to extend over the light-sensitive element of the film unit. Each silver halide emulsion is developed by the processing composition. A diffusible dye formed diffuses in an image pattern to the image-receiving layer, thereby producing a transferred image in the image-receiving layer. Thus, a color photograph can be seen with the light-reflective layer (white layer) as a background.

As a still modified embodiment, a peeling layer may be provided between the image-receiving layer and the light-sensitive element. After the formation of a transferred image, if necessary, the image-receiving layer can be separated from the light-sensitive element and used as the usual color print or color slide. The present invention is described in greater detail with reference to the following examples which are provided for illustrative purposes only and are in no way intended to limit the scope of the present invention.

EXAMPLE 1

Preparation of Core/Shell Type Direct Positive Emulsion

An aqueous solution of potassium bromide and an aqueous solution of silver nitrate were added at the same time to an aqueous solution of gelatin at 75° C. over about 60 minutes while vigorously stirring to prepare a silver bromide emulsion. Prior to precipitation, 100 mg per mole of silver of 3,4-dimethyl-1,3-thiazoline-2-thione and 15 g per mole of silver of benzoimidazole were added to a precipitation vessel. On completion of precipitation, crystals having an average grain size of about 1.1 microns were formed. To these silver bromide grains were added 5.4 mg per mole of silver of sodium thiosulfate and 3.9 mg per mole of silver of potassium chloroaurate, and the resulting mixture was heated at 75° C. for 80 minutes to apply a chemical sensitization treatment on to the silver bromide grains. To the thus-chemical sensitized core emulsion, an aqueous solution of potassium bromide and an aqueous solution of silver nitrate were added at the same time over 40 minutes in the same manner as above to prepare a core/shell emulsion. The final average grain size was 1.5 microns. There are thus obtained a core/shell type direct positive AgBr emulsion (Emulsion (A)).

To this core/shell type emulsion were added 0.32 mg per mole of silver of sodium thiosulfate and 57 mg per mole of silver of poly(N-vinyl)pyrrolidone, and the resulting mixture was heated at 60° V for 60 minutes to chemically sensitize the surface of the grains. The thus-treated emulsion is hereinafter referred to as "Emulsion (1)".

Preparation of Light-Sensitive Sheet

A light-sensitive sheet (A) was prepared by coating on a transparent polyethylene terephthalate support the layers (1) to (6) as described below in the given order.

Layer (6): Protective layer containing gelatin

Layer (5): Red-sensitive core/shell type direct positive emulsion layer

Layer (4): Layer containing a cyan DRR compound

Layer (3): Light-shielding layer

Layer (2): White reflective layer

Layer (1): Mordanting layer Support

These layers (1) to (6) are described below in detail.

Layer (1): Mordanting layer containing 3.0 g/m$^2$ of a copolymer having the repeating unit as shown below (described in U.S. Pat. No. 3,898,088) and 3.0 mg/m$^2$ of gelatin.

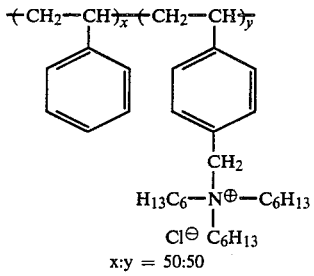

x:y = 50:50

Layer (2): White reflective layer containing 20 g/m$^2$ of titanium oxide and 2.0 g/m$^2$ of gelatin.

Layer (3): Light-shielding layer containing 2.0 g/m$^2$ of carbon black and 1.5 g/m$^2$ of gelatin.

Layer (4): Layer containing 0.44 g/m$^2$ of the cyan DRR compound as shown below, 0.09 g/m$^2$ of tricyclohexyl phosphate, and 0.8 g/m$^2$ of gelatin.

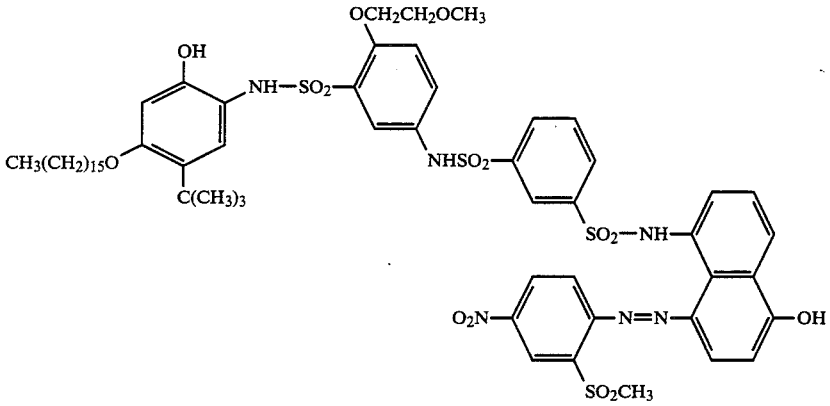

Layer (5): Red-sensitive core/shell type direct positive silver bromide emulsion layer containing 0.81 g/m$^2$ (calculated as silver) of Emulsion (1) as prepared above and, furthermore, as a red-sensitive sensitizing dye and a nucleating agent, 0.01 mg/m$^2$ of 1-fornyl-2-[4-{3-(3-phenylthioureido)benzamido}phenyl]hydrazine as described in Japanese Patent Application (OPI) No. 74729/79, 4.3 mg/m$^2$ of 4-hydroxy-6-methyl-1,3,3a-tetrazaindene, and 0.11 g/m$^2$ of sodium 5-pentadecylhydroquinone-2-sulfonate.

Layer (6): Protective layer containing 1.0 g/m$^2$ of gelatin.

Light-sensitive sheets (B) to (F) were prepared in the same manner as above except that compounds of the general formula (I) as shown in Table 1 were each added to the red-sensitive emulsion layer (5).

The light-sensitive sheets (A) to (F) were each subjected to forced stability testing by storing them for 3 days under conditions of 60° C. and 10% RH, or for 3 days under conditions of 45° C. and 75% RH.

The light-sensitive sheets, subjected or not subjected to the forced stability testing, were exposed and developed and, thereafter were measured for their photographic properties (Dmax, Dmin).

The processing solution, cover sheet, and processing conditions are shown below.

Processing Solution

| | |
|---|---|
| 1-p-Tolyl-4-methyl-4-hydroxymethyl-3-pyrazolidone | 12.0 g |
| Methylhydroquinone | 0.3 g |
| 5-Methylbenzotriazole | 3.5 g |
| Sodium sulfite | 2.0 g |
| Sodium carboxymethyl cellulose | 58 g |
| Potassium hydroxide | 56 g |
| Benzyl alcohol | 1.5 g |
| Carbon black dispersion (25%) | 600 g |
| Water to make | 1 kg |

This processing solution was charged in each portion of 0.8 g to a "pod breakable on application of pressure".

Cover Sheet

A cover sheet was prepared by coating the following layers (1') to (3') in the given order on a transparent polyethylene terephthalate support.

Layer (1'): Neutralizing layer containing 22 g/m$^2$ of an acrylic acid/butyl acrylate (80:20 by weight) copolymer and 0.44 g/m$^2$ of 1,4-bis(2,3-epoxypropoxy)-butane.

Layer (2'): Layer containing 3.8 g/m$^2$ of acetyl cellulose (hydrolysis of 100 g of the acetyl cellulose provided 39.4 g of an acetyl group), 0.2 g/m$^2$ of a styrene/maleic anhydride (60:40 by weight) copolymer (molecular weight: about 50,000), and 0.115 g/m$^2$ of 5-(β-cyanoethylthio)-1-phenyltetrazole.

Layer (3'): Layer containing 2.5 g/m$^2$ of a latex of a vinylidene chloride/methyl acrylate/acrylic acid (85:12:3 by weight) copolymer and 0.05 g/m$^2$ of a polymethyl methacrylate latex (particle diameter: 1 to 3 μm).

Exposure and Development

The cover sheet was superposed on the light-sensitive sheet, which was then exposed through a continuous gradation wedge to light from the side of the cover sheet. The above processing solution was extended in a thickness of 75μ between the sheets by means of a pressing roll. The processing was performed at 25° C. for 1 hour. Then the cyan color density of a transferred image in the mordanting layer (image-receiving layer) was measured through the transparent support of the light-sensitive sheet by the use of a Macbeth reflective densitometer. The results are shown in Table 1.

It can be seen from Table 1 that if the compounds of the general formula (I) of the present invention are added to an emulsion layer, a reduction over the course of time in Dmax is greatly improved (particularly, a decrease over the course of time in Dmax when the sheet is stored for 3 days under conditions of 60° C. and 10% RH is greatly reduced.

TABLE 1

| Light-Sensitive Sheet | Compound of the General Formula (I) Type | Amount (mole/AgX mole) | Not subjected to Forced Stability Testing Dmax | Dmin | Forced Stability Testing (60° C., 10% RH, 3 days) Dmax | Dmin | Forced Stability Testing (45° C., 75% RH, 3 days) Dmax | Dmin |
|---|---|---|---|---|---|---|---|---|
| A (control) | not added | | 2.30 | 0.33 | 1.52 | 0.33 | 1.18 | 0.33 |
| B | 1 | $1.7 \times 10^{-5}$ | 2.28 | 0.33 | 2.16 | 0.33 | 1.70 | 0.33 |
| C | 9 | $1.7 \times 10^{-5}$ | 2.28 | 0.33 | 2.08 | 0.33 | 1.48 | 0.33 |
| D | 22 | $6.0 \times 10^{-6}$ | 2.32 | 0.33 | 2.24 | 0.33 | 1.88 | 0.33 |
| E | 23 | $6.0 \times 10^{-6}$ | 2.30 | 0.33 | 2.12 | 0.33 | 1.65 | 0.33 |
| F | 29 | $6.0 \times 10^{-6}$ | 2.30 | 0.32 | 2.05 | 0.32 | 1.56 | 0.33 |

EXAMPLE 2

Equal molar amounts of an aqueous solution of potassium bromide and an aqueous solution of silver nitrate were added at the same time at 75° C. over about 40 minutes to prepare a silver bromide emulsion having an average particle diameter of about 0.6 micron. To this silver bromide emulsion were added 2.7 mg of sodium thiosulfate, 3.6 mg of potassium chloroaurate, and 0.8 mg of lead nitrate, all being per mole of silver, and the resulting mixture was heated at 75° C. for 60 minutes to achieve chemical sensitization of silver bromide grains. The thus-chemical sensitized grains were processed in the same precipitation environment except that 1.2 mole% of potassium iodide was added to the aqueous potassium bromide solution and the simultaneous mixing was performed over 50 minutes, thereby allowing additional silver halide to grow on the grains. The final average grain diameter was 1.0 micron. This is a core/shell type direct positive AgBrI emulsion and is referred to as "Emulsion (B)".

To the core/shell type emulsion, 0.36 mg of sodium thiosulfate, 0.18 mg of potassium chloroaurate, and 42 mg of poly(N-vinyl) pyrrolidone, all being per mole of silver, were added, and the resulting mixture was heated at 60° C. for 60 minutes to achieve chemical sensitization of the surface of grains. This emulsion is referred to as "Emulsion (2)".

To this silver halide emulsion was added each of Compounds 2, 10, 22, 24, and 28 as listed above as compounds of the general formula (I). Using these emulsions, five light-sensitive sheets were prepared in the same manner as in Example 1. The sheets were subjected to the forced stability testing under the same conditions as in Example 1. It has been found that in the light-sensitive materials of the present invention the decrease in Dmax over the course of time is greatly improved.

EXAMPLE 3

Light-sensitive sheets (G) and (H) were prepared in the same manner as in the preparation of Light-Sensitive Sheet (A) of Example 1 except that a compound of the general formula (I) was added to the cyan DRR compound-containing layer (4) and the gelatin-containing protective layer (6), respectively.

The light-sensitive sheets (G), (H), and (A) were subjected to the forced stability testing by storing them for 3 days under conditions of 60° C. and 10% RH.

The light-sensitive sheets, subjected or not subjected to the forced stability testing, were exposed and developed in the same manner as in Example 1. After the processing was performed for 1 hour, the cyan color density of an image formed in the mordanting layer was measured through the transparent support of the light-sensitive sheet by means of a Macbeth reflective densitometer. The results are shown in Table 2.

It can be seen from the results of Table 2 that even if the compound of the present invention is added to a layer adjacent to the emulsion layer, over the course of time in Dmax is reduced.

TABLE 2

| Light-Sensitive Sheet | Compound of the General Formula (I) Type | Layer for Compound to be added | Amount (μg/m²) | Not subjected to Forced Stability Testing Dmax | Dmin | Forced Stability Testing (60° C., 10% RH, 3 days) Dmax | Dmin | ΔDmax |
|---|---|---|---|---|---|---|---|---|
| A (control) | | not used | | 2.20 | 0.34 | 1.06 | 0.34 | −1.14 |
| G | 22 | Layer (4) | 8.2 | 2.20 | 0.34 | 1.82 | 0.34 | −0.38 |
| H | 22 | Layer (6) | 8.2 | 2.20 | 0.34 | 1.92 | 0.34 | −0.28 |

EXAMPLE 4

Emulsions (3) and (4) were prepared as follows.

Emulsion (3)

To Emulsion (A) (core/shell type emulsion not subjected to chemical sensitization) as prepared in Example 1 were added 43 mg of poly(N-vinyl) pyrrolidone and 0.32 mg of Compound 21 of the general formula (I), all being per mole of silver, and the resulting mixture was heated at 60° C. for 50 minutes to achieve chemical sensitization of the surface of the grains.

Emulsion (4)

Emulsion (4) was prepared in the same manner as above except that 0.89 mg per mole of silver of Compound 21 was used.

These emulsions (3) and (4) were coated on a transparent polyethylene terepthalate support in the same manner as in Example 1 to prepare light-sensitive sheets (I) and (J), respectively. (In the layer (5) of Example 1, the emulsions (3) and (4) were coated in the same amount in place of the emulsion (1).) In addition, a light-sensitive sheet (K) was prepared in the same manner as above except that just before coating, Compound 21 was added to the emulsion (3) in an amount of 0.57 mg per mole of silver.

The above light-sensitive sheets (I), (J), and (K) were subjected to the forced stability testing by storing for 3 days under conditions of 60° C. and 10% RH.

The light-sensitive sheets, subjected or not subjected to the forced stability testing, were exposed and developed in the same manner as in Example 1 and, thereafter, measured for the cyan color density in the same manner as in Example 1. The results are shown in Table 3.

From the results, the following can be seen.

In the light-sensitive sheet (I) in which the emulsion (3) subjected to surface chemical sensitization using Compound 21 of the present invention was used, a decrease in Dmax when it was stored for 3 days under conditions of 60° C. and 10% RH was considerably large.

In the light-sensitive sheet (J) in which the emulsion (4) subjected to surface chemical sensitization using an increased amount of Compound 21 was used, prior to the forced stability testing, Dmax is low and Dmin is high. This demonstrates that in the emulsion (4) the surface chemical sensitization was carried out beyond the optimum extent (the emulsion (3) is most suitable).

If Compound 21 is added last to the emulsion (3), a decrease over the course of time in Dmax is greatly improved while maintaining the optimum reversal performance.

Thus, it can be seen from the results of Table 3 that it is only when the compounds of the general formula (I) are added as final additives after completion of the surface chemical sensitization of the core/shell type emulsion that the effects of the compounds of the general formula (I) are obtained, while maintaining satisfactory reversal performance, a decrease in Dmax over the course of time can be improved.

TABLE 3

| Light-Sensitive Sheet | Amount of Compound 21: Added at the time of surface chemical sensitization (mg/mole AgX) | Amount of Compound 21: Added just before Coating (Final Addition) (mg/mole AgX) | Not subjected to Forced Stability Testing: Dmax | Not subjected to Forced Stability Testing: Dmin | Subjected to Forced Stability Testing for 3 Days at 60° C. and 10% RH: Dmax | Subjected to Forced Stability Testing for 3 Days at 60° C. and 10% RH: Dmin |
|---|---|---|---|---|---|---|
| I (Emulsion (3)) | 0.32 | not contained | 2.08 | 0.34 | 0.80 | 0.33 |
| J (Emulsion (4)) | 0.89 | not contained | 1.64 | 0.40 | 2.02 | 0.38 |
| K (Emulsion (3)) | 0.32 | 0.57 | 2.08 | 0.34 | 1.84 | 0.33 |

EXAMPLE 5

Light-sensitive sheets (L) and (M) were prepared by coating the layers (1') to (18') on a transparent polyethylene terephthalate support in the layer structure shown below.

Layer (18'): Protective layer containing gelatin

Layer (17'): Ultraviolet absorbing layer

Layer (16'): Blue-sensitive core/shell type direct positive emulsion layer

Layer (15'): White light-reflective layer

Layer (14'): Layer containing a yellow DRR compound

Layer (13'): Intermediate layer containing gelatin

Layer (12'): Color mixing-preventing layer

Layer (11'): Green-sensitive core/shell type direct positive emulsion layer

Layer (10'): White light-reflective layer

Layer (9'): Layer containing a magenta DRR compound

Layer (8'): Intermediate layer containing gelatin

Layer (7'): Color mixing-preventing layer

Layer (6'): Red-sensitive core/shell type direct positive emulsion layer

Layer (5'): White light-reflective layer

Layer (4'): Layer containing a cyan DRR compound

Layer (3'): Light-shielding layer

Layer (2'): White light-reflective layer

Layer (1'): Mordanting layer

These layers are described below in detail.

Layer (1'): Same mordanting layer as in Example 1.

Layer (2'): Same white reflective layer as in Example 1.

Layer (3'): Same light-shielding layer as in Example 1.

Layer (4'): Layer containing the same cyan DRR compound as in Example 1.

Layer (5'): White light-reflective layer containing 2.8 g/m$^2$ of titanium oxide and 1.0 g/m$^2$ of gelatin.

Layer (6'): Red-sensitive core/shell type direct positive silver bromide emulsion containing 1.12 g/m$^2$ (calculated as silver) of the emulsion (1) of Example 1 and, furthermore, as a red-sensitive sensitizing dye and a nucleating agent, 0.02 mg/m$^2$ of the compound of Example 1, 5.9 mg/m$^2$ of 4-hydroxy-6-methyl-1,3,3a-tetrazaindene, and 0.13 g/m$^2$ of sodium 5-pentadecylhydroquinone-2-sulfonate (Light-Sensitive Sheet (L)), or the same red-sensitive core/shell type direct positive silver bromide emulsion as above, further containing 0.012 mg/m$^2$ of Compound 22 (Light-Sensitive Sheet (M)).

Layer (7'): Color mixing-preventing layer containing 1.0 g/m$^2$ of 2,5-di-tert-pentadecylhydroquinone and 0.8 g/m$^2$ of gelatin.

Layer (8'): Intermediate layer containing 0.18 g/m$^2$ of gelatin.

Layer (9'): Layer containing 0.21 g/m$^2$ of a magenta DRR compound having the formula (I) as shown below, 0.11 g/m$^2$ of a magenta DRR compound having the formula (II) as shown below, 0.08 g/m$^2$ of tricyclohexyl phosphate, and 0.9 g/m$^2$ of gelatin.

Formula I

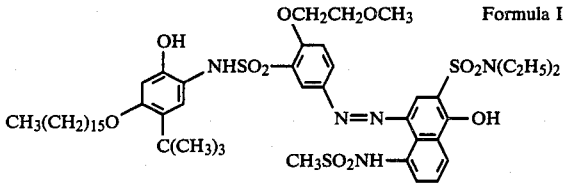

Formula II

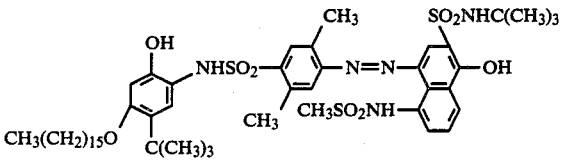

Layer (10'): White light-reflective layer containing 1.0 g/m$^2$ of titanium oxide and 0.36 g/m$^2$ of gelatin.

Layer (11'): Green-sensitive core/shell type direct positive silver bromide emulsion layer containing 0.78 g/m$^2$ (calculated as silver) of the emulsion (1) of Example 1 and, furthermore, as a green-sensitive sensitizing dye and a nucleating agent, 0.01 g/m$^2$ of the compound of Example 1 and 4.1 mg/m$^2$ of 4-hydroxy-6-methyl-1,3,3a-tetrazaindene, and 0.09 g/m$^2$ of sodium 5-pentadecylhydroquinone-2-sulfonate (Light-Sensitive Sheet (L)), or the same green-sensitive core/shell type direct positive silver bromide emulsion layer as above, further containing 0.0082 mg/m$^2$ of Compound 22 (Light-Sensitive Sheet (M).

Layer (12'): Same layer as the layer (7').

Layer (13'): Same layer as the layer (8').

Layer (14'): Layer containing 0.53 g/m$^2$ of a yellow DRR compound having the formula as shown below, 0.13 g/m$^2$ of tricyclohexyl phosphate, and 0.7 g/m$^2$ of gelatin.

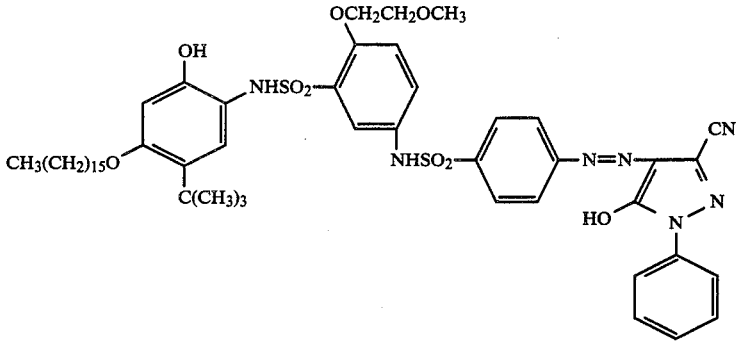

Layer (15'): Light-reflective layer containing 0.6 g/m$^2$ of titanium oxide and 0.21 g/m$^2$ of gelatin.

Layer (16'): Blue-sensitive core/shell type direct positive silver bromide emulsion containing 1.27 g/m$^2$ (calculated as silver) of the emulsion (1) of Example 1, as a blue-sensitive sensitizing dye and a nucleating agent, 0.025 mg/m$^2$ of the compound of Example 1 and 5.2 mg/m$^2$ of 4-hydroxy-6-methyl-1,3,3a-tetrazaindene, and 0.07 g/m$^2$ of sodium 5-pentadecylhydroquinone-2-sulfonate (Light-Sensitive Sheet (L)), or the same blue-sensitive core/shell type direct positive silver bromide emulsion as above, further containing 0.013 mg/m$^2$ of Compound 22 (Light-Sensitive Sheet (M)).

Layer (17'): Ultraviolet absorbing layer containing $4\times10^{-4}$ mole/m$^2$ of each of ultraviolet absorbers having the formulae as shown below, and 0.50 g/m$^2$ of gelatin.

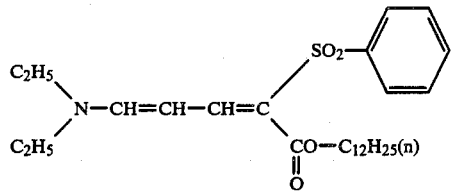

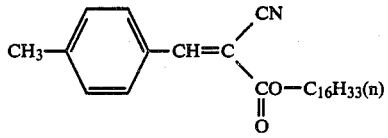

Layer (18'): Protective layer containing 0.10 g/m$^2$ of a polymethyl methacrylate latex (average particle size: 4$\mu$), 0.8 g/m$^2$ of gelatin, and 0.02 g/m$^2$ of triacroyltriazine as a harderner.

The light-sensitive sheets (L) and (M) were subjected to the forced stability testing by storing for 3 days under conditions of 60° C. and 10% RH, or for one month under conditions of 40° C. and 10% RH. They were also subjected to the natural stability test by storing them at room temperature (from 17° to 27° C.) for 45 days.

Alternatively the light-sensitive sheets were stored in a refrigerator maintained at −15° C. (fresh sheets).

These light-sensitive sheets were imagewise exposed in the same manner as in Example 1 and then a processing solution having the formulation as shown below was extended in a thickness of 80$\mu$ between the light-sensitive sheet and the cover sheet in the same manner as in Example 1. After the processing was performed for 1 hour, the density of a transferred image formed in the mordanting layer (image-receiving layer) was measured through the transparent support of the light-sensitive sheet by means of a color densitometer. The results are shown in Table 4.

Processing Solution

| | |
|---|---|
| Carbon black dispersion (carbon black content: 25%) | 600 g |
| Sodium sulfite | 2 g |
| Silver nitrate | 0.2 g |
| Benzyl alcohol | 2 g |
| 5-Methylbenzotriazole | 3.5 g |
| Carboxymethyl cellulose | 60 g |
| Tert-butylhydroquinone | 0.2 g |

-continued

| | |
|---|---|
| 1-Para-tolyl-4-methyl-4-hydroxy-methyl-3-pyrazolidone | 10 g |
| Potassium hydroxide | 56 g |
| Water to make | 1 kg |

The processing solution was charged to a "pod breakable upon application of pressure" each in an amount of 0.8 g.

It can be seen from the results of Table 4 that the light-sensitive materials containing the compounds of the general formula (I) are greatly improved in the decrease in Dmax over the course of time.

It can be seen from Table 5 that when the amount of 4-hydroxy-6-methyl-1,3,3a-tetrazaindene to be added as a stabilizer is increased, stability over the course of time is improved but color sensitized sensitivity drops, while on the other hand when the compound of the present invention is incorporated, stability over the course of time can be improved while retaining a satisfactory color sensitized sensitivity.

While the invention has been described in detail and with reference to specific embodiment thereof, it will be apparent to one skilled in the art that various changes and modifications can be made therein without departing from the spirit and scope thereof.

TABLE 5

| Light Sensitive Sheet | 4-Hydroxy-6-methyl-1,3,3a-tetrazaindene ($mg/m^2$) | Compound of the Present Invention | Fresh | | | Stored at 60° C. and 10% RH for 3 Days | |
|---|---|---|---|---|---|---|---|
| | | | Dmax | Dmin | S ½ rel.* | Dmax | Dmin |
| A (Control) | 4.3 | none | 2.30 | 0.33 | 100 | 1.52 | 0.33 |
| D | 4.3 | added | 2.32 | 0.33 | 100 | 2.24 | 0.33 |
| N | 12.9 | none | 2.38 | 0.33 | 80 | 2.08 | 0.33 |

Note:
*S ½ rel. Relative value of photographic sensitivity to red light at a density of (Dmax + Dmin)/2.

TABLE 4

| Light-Sensitive Sheet | Stored in Refrigerator (Fresh) | | Stored for 3 Days at 60° C. and 10% RH | | Stored for 1 Month at 40° C. and 10% RH | | Stored at Room Temperature for 45 Days | |
|---|---|---|---|---|---|---|---|---|
| | Dmax | Dmin | Dmax | Dmin | Dmax | Dmin | Dmax | Dmin |
| L (control) | | | | | | | | |
| Cyan | 2.24 | 0.34 | 1.52 | 0.34 | 1.86 | 0.34 | 2.06 | 0.34 |
| Magenta | 2.20 | 0.23 | 1.68 | 0.23 | 1.80 | 0.23 | 2.04 | 0.23 |
| Yellow | 1.80 | 0.24 | 1.52 | 0.24 | 1.68 | 0.24 | 1.76 | 0.24 |
| M (containing the compound of the general formula (I)) | | | | | | | | |
| Cyan | 2.24 | 0.34 | 2.16 | 0.34 | 2.20 | 0.34 | 2.24 | 0.34 |
| Magenta | 2.20 | 0.23 | 2.14 | 0.23 | 2.18 | 0.23 | 2.20 | 0.23 |
| Yellow | 1.80 | 0.24 | 1.76 | 0.24 | 1.78 | 0.24 | 1.80 | 0.24 |

EXAMPLE 6

A light-sensitive sheet (N) was prepared in the same manner as in the preparation of the light-sensitive sheet (A) of Example 1 except that the amount of 4-hydroxy-6-methyl-1,3,3a-tetrazaindene to be added to the layer (5) was increased to 12.9 $mg/m^2$.

The light-sensitive sheets (N), and the light-sensitive sheet (A) (control) and the light-sensitive sheet (D) (containing the compound of the general formula (I) of Example 1 were each combined together with the same cover sheet as used in Example 1 and exposed through a continuous gradation wedge to red light from the side of the cover sheet. Between the light-sensitive sheet and the cover sheet was extended in a thickness of 75μ the same processing solution as in Example 1. The processing was performed at 25° C. After the processing was performed for 1 hour, the cyan color density of a transferred image formed in the mordanting layer (image-receiving layer) was measured through the transparent support of the light-sensitive sheet by means of a color densitometer to determine Dmax, Dmin, and S½ rel. (photographic sensitivity).

The above light-sensitive sheets (A), (D), and (N) were stored for 3 days under conditions of 60° C. and 10% RH and, thereafter, exposed and developed in the same manner as above. The results are shown in Table 5.

What is claimed is:

1. An internal latent image-type direct positive silver halide light-sensitive material comprising a support having at least one photographic emulsion layer coated thereon, wherein said photographic emulsion layer contains internal latent image-type direct positive silver halide grains, the surfaces of which are chemically sensitized, wherein a stabilizing compound represented by the general formula (I) is added as a finish additive to the photographic emulsion layer or at least one hydrophilic colloid layer adjacent to the photographic emulsion layer,

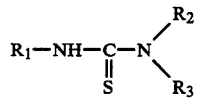

(I)

wherein:

$R_1$ is a saturated or unsaturated aliphatic radical, an aromatic radical, a nitrogen atom-containing 5- or 6-membered heterocyclic radical, or an acyl group;

$R_2$ is a hydrogen atom, a saturated or unsaturated aliphatic radical, or an aromatic radical;

$R_3$ is the same as defined for $R_1$ or $R_2$;

$R_2$ and $R_3$ may combine together to form a heterocyclic ring; and $R_1$ to $R_3$ and the heterocyclic ring formed from $R_2$ and $R_3$ may be substituted, provided that when $R_2$ is an aromatic radical, the substituent does not include a group with hydrazine or its derivative linked thereto.

2. An internal latent image-type direct positive silver halide light-sensitive material as claimed in claim 1, wherein the compound of general formula (I) is incorporated in the photographic emulsion layer in an amount of from $5\times10^{-7}$ to $1\times10^{-4}$ mole per mole of silver.

3. An internal latent image-type direct positive silver halide light-sensitive material as claimed in claim 1, wherein the compound of general formula (I) is incorporated in the photographic emulsion layer in an amount of from $1\times10^{-6}$ to $5\times10^{-5}$ mole per mole of silver.

4. An internal latent image-type direct positive silver halide light-sensitive material as claimed in claim 1, wherein said material additionally comprises an image-receiving element or an image-receiving layer.

5. An internal latent image-type direct positive silver halide light-sensitive material as claimed in claim 1, wherein said material additionally comprises an image-receiving element and a processing composition-supplying means.

6. An internal latent image-type direct positive silver halide light-sensitive material as claimed in claim 1, wherein $R_1$ and $R_2$ are aliphatic radicals selected from the group consisting of a straight or branched chain alkyl group which may be substituted, a cycloalkyl group which may be substituted an alkenyl group and an alkynyl group.

7. An internal latent image-type direct positive silver halide light-sensitive material as claimed in claim 6, wherein said straight or branched chain alkyl group has 1–10 carbon atoms.

8. An internal latent image-type direct positive silver halide light-sensitive material as claimed in claim 7, wherein said straight or branched chain alkyl group has 1–5 carbon atoms.

9. An internal latent image-type direct positive silver halide light-sensitive material as claimed in claim 6, wherein said cycloalkyl group contains from 3 to 6 carbon atoms.

10. An internal latent image-type direct positive silver halide light-sensitive material as claimed in claim 6, wherein said alkenyl group is an allyl group.

11. An internal latent image-type direct positive silver halide light-sensitive material as claimed in claim 6, wherein said alkynyl group is a propargyl group.

12. An internal latent image-type direct positive silver halide light-sensitive material as claimed in claim 1, wherein said acyl group is selected from the group consisting of an aliphatic acyl group and an aromatic acyl group.

13. An internal latent image-type direct positive silver halide light-sensitive material as claimed in claim 1, wherein said aromatic group represented by $R_1$ and $R_2$ is a phenyl group or a substituted phenyl group.

14. An internal image-type direct positive silver halide light-sensitive material as claimed in claim 1, wherein said nitrogen atom-containing 5- or 6-membered heterocyclic radical represented by $R_1$ is selected from the group consisting of a pyrroline ring, an oxazole ring, a benzo-oxazole ring, quinoline ring, an indole ring, a pyridine ring, an imidazole ring, a benzoimidazole ring, a thiazoline ring, a thiazole ring, a benzothiazole ring, a selenazole a ring, benzoselenazole ring, a triazole ring and a thiadiazole ring.

15. An internal image-type direct positive silver halide light-sensitive material as claimed in claim 1, wherein $R_2$ and $R_3$ combine to form a heterocyclic ring selected from the group consisting of a morpholine ring, a piperidine ring, a piperazine ring, and a pyrrolidine ring.

16. An internal image-type direct silver halide light-sensitive material as claimed in claim 1, wherein the sulfur-containing compound of the general formula (I) is added after sensitizing and before coating of an emulsion.

17. An internal latent image-type direct positive silver halide light-sensitive material as claimed in claim 1, wherein said internal latent image-type direct positive silver halide grains are core/shell type grains.

18. An internal latent image-type direct positive silver halide light-sensitive material as claimed in claim 17, wherein the surface of the core/shell type grains is subjected to an optimum degree of surface chemical sensitization.

19. An internal latent image-type direct positive silver halide light-sensitive material as claimed in claim 1, wherein the surface of the internal latent image-type direct positive silver halide grains are subjected to sulfur sensitization.

20. An internal latent image-type direct positive silver halide light-sensitive material as claimed in claim 17, wherein the surface of the internal latent image-type direct positive silver halide grains are subjected to sulfur sensitization with poly(N-vinylpyrrolidone).

* * * * *